United States Patent [19]

Lankard et al.

[11] 4,081,283

[45] Mar. 28, 1978

[54] PLASTER MOLDING COMPOSITION

[75] Inventors: David R. Lankard, Columbus; Walter A. Hedden, Worthington, both of Ohio

[73] Assignee: PMCMA Research Group, Dayton, Ohio

[21] Appl. No.: 660,444

[22] Filed: Feb. 23, 1976

[51] Int. Cl.[2] ..... B28B 7/28

[52] U.S. Cl. ..... 106/38.3; 106/38.9; 106/109; 106/110; 106/315; 106/DIG. 1

[58] Field of Search ..... 106/109, 110, 38.3, 106/38.9, 315, DIG. 1

[56] References Cited

U.S. PATENT DOCUMENTS

| | | | |
|---|---|---|---|
| 2,508,600 | 5/1950 | Fitzsimmons | 106/109 |
| 3,100,715 | 8/1963 | Leonard | 106/110 |
| 3,311,516 | 3/1967 | Jaunarajs et al. | 106/110 |
| 3,369,929 | 2/1968 | Petersen | 106/109 |
| 3,804,701 | 4/1974 | Bognar | 106/38.3 |
| 3,862,881 | 1/1975 | Taniguchi et al. | 106/110 |

*Primary Examiner*—Winston A. Douglas
*Assistant Examiner*—John P. Sheenan
*Attorney, Agent, or Firm*—Biebel, French & Nauman

[57] ABSTRACT

A fibrous talc-free plaster molding composition comprises by weight approximately 50–70% gypsum plaster, 5–20% fibrous wollastonite, 5–25% fine expanded perlite, and 0–40% of a filler selected from the group consisting of sand, fly ash, pyrophyllite and mixtures thereof. The composition of this invention has good dry blending properties, slurry characteristics, and wet and dry mold features, making it a suitable replacement for fibrous talc-containing molding compositions for low fusion metal casting molds.

9 Claims, No Drawings

PLASTER MOLDING COMPOSITION

BACKGROUND OF THE INVENTION

This invention relates to plaster molding compositions and, more particularly, to a suitable molding composition to replace the gypsum-fibrous talc-sand mixtures commonly used in preparing metal castings molds.

Low temperature fusion metals, such as aluminum, have for generations been cast in disposable plaster molds made primarily from calcined gypsum plaster (i.e., plaster of paris) and a fibrous talc (an asbestos like material). While even as early as around 1900, there were suggested improvements (see for example, U.S. Pat. Nos. 816,833 and 821,718), the commercial mix has remained essentially unchanged to the present day.

Typically, these fine castings molding compositions comprise around 50% gypsum plaster, 30% fibrous talc, 19% sand, 1% Portland cement and a small amount of an accelerator such as Terra Alba. Such a plaster mold composition is ideally suited to an end use of this particular type.

That end use involves (1) dry blending of the components into a molding composition, (2) slurrying the dry blend with water, (3) pouring the slurry around a master pattern, (4) stripping the hardened wet mold from the master, (5) trimming and patching as necessary, (6) drying in an oven, (7) gating and inserting chills (8) pouring the molten metal such as aluminum in the mold, (9) cooling, (10) separating the cast metal shape from the mold by using a high-pressure water blast-off, and (11) disposing of or recycling the used mold. Slurrying is usually done in a Hogue machine (a screw-type blender).

The fibrous-talc containing molding composition meets the various requirements needed of the material at each step. It is easily dry blended. The materials are relatively inexpensive. Slurry characteristics are good, making mixing in a Hogue machine possible. Setting times are fast. The wet and dry mold features are acceptable in terms of density, strength, permeability, shrinkage, and penetration resistance. In addition, the mold surfaces produced with such compositions are of generally good quality.

Despite all of this, gypsum-fibrous talc-sand molding compositions can no longer be used in making metal castings molds. The reason is that the fibrous talc has been removed from commerce because it is allegedly objectionable as a health hazard under recently enacted OSHA regulations. The need thus exists for a suitable fibrous talc-free replacement for such molding compositions.

One possibility is use of a composition marketed by Georgia Pacific Corp. of Portland, Oregon. It utilizes approximately 74% gypsum plaster, 12% wollstonite, 9% diatomaceous earth, 3% sand, and 2% calcium aluminate cement. The problem with this type of composition is that during slurrying in the Hogue machine, it does not achieve the consistency required quickly enough. Thus, the slurry poured onto the master is too thin so that material segregation occurs due to settling with resultant adverse affects on the quality of the plaster mold itself and metals cast into it. Of course as the plaster hydrates and sets up, the slurry thickness is increased to the point where a proper consistency is achieved, but by this time it has lost its usefulness relative to its use in the continuous commercial mixing machines.

Accordingly, there remains an urgent need to develop a fibrous talc-free molding composition having characteristics at least as good as those of the fibrous talc-containing molding compositions. The urgency comes from the fact that the previous sources of supply of fibrous talc are no longer usable.

SUMMARY OF THE INVENTION

The present invention meets that need by providing a fibrous talc-free molding composition for use in making metal castings molds. The composition of this invention comprises by weight approximately 50–70% gypsum plaster, 5–20% fibrous wollastonite, 5–25% fine expanded perlite, 0–40% filler, and, optionally, a minor amount of accelerator.

The gypsum plaster is a calcined gypsum (plaster of paris) such as that known as No. 1 Molding Plaster from U.S. Gypsum Co., Chicago, Ill. Fibrous wollastonite is an acicular (calcium metasilicate) material; a particularly good grade for the present invention is F-1 wollastonite from Interpace Corp., Willboro, New York. The expanded perlite used is a fine expanded silicous volcanic rock material, at least 50% of which will pass through a -50 mesh screen. This would include Grades No. 4, 3S or 39 Ryolex perlite from the Silbrico Corp. of Hodgkins, Illinois. Fillers for use in the present invention may be selected from the group consisting of sand, fly ash, pyrophyllite or mixtures thereof. The accelerator may be Terra Alba or any other known accelerator for gypsum plaster.

As can be seen, the replacement of the fibrous talc of prior molding compositions comes primarily from the use of the combination of fibrous wollastonite and fine expanded perlite. The fibrous wollastonite provides for strength and reinforcement. The expanded perlite aids in establishing adequate slurry characteristics. Together, they synergistically lead to molding compositions which are equal to or better than fibrous talc-containing mixtures. To illustrate, a catalog of some of the desirable qualities of the molding composition of the present invention follows:

A. Dry Blend Properties

1. The ingredients are all readily available from existing sources.
2. All ingredients are non-hazardous to the user.
3. The materials are, at least at present, relatively inexpensive.
4. Batch mixing is possible and the dry feed flowability good.
5. The present composition is compatible with existing blending and handling systems.

B. Slurry Characteristics

1. The slurried composition has good fluidity and will pick up the detail of the master.
2. Upon mixing in the Hogue machine for short periods of time, a creamy state is established, eliminating settling of the dense ingredients.
3. A low temperature (less than 120° F) operation is possible.
4. The slurried mold composition has a fast setting time (5–20 minutes).
5. The water-to-solids ratio (the amount of water added per unit weight solids) is acceptable.
6. The release characteristics from the master pattern are good.

C. Wet Mold Features

1. The newly cast mold of the composition of the present invention has good green strength.

2. The setting expansion is low.
3. The wet mold is easily cut (shaved) in trimming.
4. Likewise, it is easily patched or repaired.
5. Finally, it is able to take a reverse cast.

D. Dry Mold Features

1. Acceptable permeability of the dry mold can be achieved.
2. Burnout shrinkage (that occurring on drying the plaster mold) is low, less than 0.1%.
3. Low drying temperatures (less than 400° F) are required.
4. There is no migration of salts to the surface on drying.
5. The mold surface is generally free of blisters and cracks.
6. A low thermal shock sensitivity is found, i.e., it is not necessary to cool slowly on removal from the drying oven.
7. The dry mold has a relatively low bulk density which is good in terms of ease of gating, inserting chills, etc.
8. Likewise, the mold is soft enough to insert the chill wires easily and, therefore, it is possible to use chills to cool and the mold rapidly and thoroughly during casting.
9. The mold also has a low enough dry strength to permit easy crushing for disposal for recycling.
10. There is no metal discoloration from the mold.
11. The mold is easily separated from the casting.

With all of these features obtainable using the molding composition of the present invention, it can be seen that a suitable replacement for fibrous talc-containing molding compositions is provided.

Accordingly, it is an object of the present invention to provide such a suitable fibrous talc-free molding composition.

Other objects and advantages of the present invention will be apparent from the following description and the appended claims.

Description of the Preferred Embodiments

As mentioned, the preferred composition of the present invention comprises approximately 50–70% gypsum plaster, 5–20% fibrous wollastonite, 5–25% fine expanded perlite, and 0–40% filler. More preferably, it consists by weight of 60% gypsum plaster, 15% fibrous wollastonite, 7.5–15% fine expanded perlite, 10–17.5% sand, and a small amount of Terra Alba. The preferred gypsum plaster is such as that marketed by U.S. Gypsum under the designation No. 1 Molding Plaster. The more plaster used, the more rapid the setting time, the stronger the mold, etc. While setting times are generally desired, too much dry mold strength is to be avoided. The 50–70% amount is therefore preferred although possibly larger amounts could be used.

The preferred wollastonite grade is F-1 from Interpace Corp. Wollastonite is a calcium metasilicate. It is acicular, and wollastonite aggregates have been used in the past in refractory molds (U.S. Pat. No. 3,802,891) and is wallboard (U.S. Pat. No. 3,838,806). Its utility in these instances derives mainly from its high temperature resistances. The fibrous form is produced by shearing the wollastonite ore. Grade F-1 is the most fibrous, having an average particle size by Fisher Sub-Sieve Sizer of 8.2, a 50% median size of 22 microns, and a loose bulk density of 27 lbs./cu.ft.

The high pH (9.9) and thermal characteristics of the fibrous wollastonite are also important properties for the intended use here. The higher the amount of wollastonite used, the higher the internal strength characteristics of the resultant mold. The preferred amount (5–20%) is ideally suited to provide adequate reinforcement without producing a mold which cannot be worked with adequately.

On the other hand, it can generally be said that the more expanded perlite used, the less dense and softer the dry mold will be. The less perlite, the harder and stronger. Accordingly, since it is desirable to produce a mold which is not only strong enough to handle and receive the metal castings, but also soft enough to shave, insert chill wires, etc., an intermediate level of expanded perlite (i.e., 7.5–15%) is most preferred.

Likewise, it is desirable that the expanded perlite particles be as fine as possible. This is because larger expanded perlite particles could cause undesirable grainy textures on the cast metal surface. Perlite is an expandable silicous volanic rock, i.e., when heated above 1600° F, crushed perlite rock expands in a manner similar to popcorn. This creates microballoons within the material. In its coarser state, expanded perlite is used as a lightweight aggregate in wall plasters and wallboard. See, for example, U.S. Pat. Nos. 2,871,134; 2,980,548; 3,183,107; 3,226,243; and 3,311,516. The larger particles of the expanded perlite contain relatively large microballoons. On the surface of the mold, then, microballoons which are too large cause voids beneath the mold surface which is ruptured, produce the undesirable graining cast metal surface. Therefore, the expanded perlite used in the present invention should be sufficiently small so that at least 50% passes a −50 mesh screen. Most preferred is the finest grade available such as No. 4 Ryolex perlite from Silbrico Corp. That material is so fine that over 85% passes a −325 mesh screen.

Other acceptable materials include Grades 3S and 39 Ryolex perlite. These grades have the particle size gradation given in Table 1 following:

TABLE I

| Weight Percent of Material Retained in Indicated Sieve | Ryolex Expanded Perlite No. 4 | No. 39 | No. 3S |
|---|---|---|---|
| +16 | — | — | Trace |
| −16+20 | — | — | 2 |
| −20+30 | — | 2 | 12 |
| −30+50 | — | 35 | 36 |
| −50+100 | — | 45 | 30 |
| −100+200 | — | 10 | 20 |
| −200+325 | — | 8 | — |
| −325 | 85 (minimum passing) | — | — |
| Packaged Density, lb/ft$^3$ | 10 | 7 | 3 |

Since the fine expanded perlite serves, among other things, as a thickening agent for the slurried composition, the amount of water required for slurrying depends in large part on the amount of expanded perlite used. That is, in the fibrous talc-containing compositions of the past, a water/solids (w/s) figure of around 1.0–1.3 was preferred for a slurry having all the desired characteristics. The optimum water-solids ratio useful in preparing slurries of the present compositions varies according to the amount of expanded perlite used. In Table 2, below, these optimum w/s figures are given. The following discussion of mold composition trials and tables deals, then, with ones mixed at the optimum water/solids ratio based on Table II. The acceptable w/s ratios for slurrying can be said to range around the optimum ± .2.

TABLE II

| Expanded Perlite Content (Weight %) | Optimum W/S Weight Ratio |
|---|---|
| 5 | 0.8 |
| 7.5 | 0.95 |
| 10 | 1.05 |
| 12.5 | 1.15 |
| 15 | 1.30 |
| 17.5 | 1.40 |
| 20 | 1.55 |
| 25 | 1.80 |

EXAMPLE I

Using the optimum w/s water amounts, a number of trials were made on various molding compositions. These slurried compositions (with water at 105° F) were subjected to several tests in both the wet and dry mold states. The mold was dried in a 400° F oven until the mold itself reached 300° F. The results are given in Table III. Composition A therein is one containing fibrous talc such as that used in the past. Composition B is: 60% No. 1 Molding Plaster from U.S. Gypsum, 15% F-1 Fibrous wollastonite from Interpace,
10% Ryolex perlite (No. 4) from Silbrico,
15% -70 mesh sand, and
Terra Alba (added to the above formulation at the rate of 2% by weight of plaster)

Composition C is:

60% No. 1 Molding Plaster
15% F-1 fibrous wollastonite
15% No. 4 Ryolex perlite
10% -70 mesh sand, and
Terra Alba (added to the above composition at the rate of 1% by weight of plaster)

TABLE III

| | Bulk Density pcf | | MOR psi | | Burnout Shrinkage | Permeability AFS | Penetration Resistance |
|---|---|---|---|---|---|---|---|
| | Wet | Dry | Wet | Dry | % | Number | lb. |
| A. | 90 | 45 | 94 | 74 | 0.08 | 0.45 | 8 |
| B. | 90 | 43 | 95 | 73 | 0.04 | 0.50 | 8 |
| C. | 83 | 36 | 62 | 38 | 0.06 | 0.55 | 5 |

As can be seen, the molds from Compositions B and C of the present invention equaled or exceeded the fibrous talc-containing Composition A in all regards. That is, the lower the bulk density (as long as the strength is maintained), the better. Both B and C had a lower bulk density. And yet, the flexural strength in terms of modulus of rupture (MOR) was in the desired 50–100 psi range for the green strength; although Composition C was somewhat on the low end of this range (i.e., not as strong).

Likewise, the molds from Compositions B and C exhibited a better (lower percentage) burnout shrinkage and a better (higher) AFS permeability. The permeability is determined by drawing air through a 2 inch diameter, two inch high cylinder of the mold material using a partial vacuum. In terms of penetration resistance, the lower the value the better, since this is the determinative factor on ease of shaving, inserting chill wires, etc. Composition B equaled that of A, and C exceeded it. Penetration resistance is the amount of pressure in pounds taken to push a ⅛ inch diameter steel spike, one inch into the dry mold.

EXAMPLE II

The same trials were made with mold compositions wherein the amount of No. 4 Ryolex expanded perlite was varied between 5% and 25% and all other components maintained as a constant except for the amount of sand, which decreased proportionately from 20% to 0% as the amount of expanded perlite used was increased. The results are given in Table IV.

TABLE IV

| Perlite | Bulk Density pcf | | MOR psi | | Burnout Shrinkage | Permeability AFS | Penetration Resistance |
|---|---|---|---|---|---|---|---|
| | Wet | Dry | Wet | Dry | % | No. | lb. |
| 5 | 97 | 52 | 175 | 119 | 0.06 | 0.20 | 18 |
| 7.5 | 92 | 46 | 97 | 79 | 0.04 | 0.59 | 18 |
| 10 | 90 | 43 | 95 | 73 | 0.04 | 0.50 | 8 |
| 12.5 | 86 | 38 | 64 | 38 | 0.03 | 0.67 | 10 |
| 15 | 83 | 36 | 62 | 38 | 0.06 | 0.55 | 5 |
| 17.5 | 83 | 34 | 53 | 41 | 0.05 | 0.98 | 8 |
| 20 | 82 | 32 | 50 | 39 | 0.06 | 0.71 | 2 |
| 25 | 80 | 28 | 40 | 32 | 0.07 | 0.99 | 2 |

Table IV illustrates the fact that within the most preferred expanded perlite range (7.5 – 15%), all desired criteria are met; whereas, even in the broad range satisfactory performance is achieved for the most part. However, it should be noted that at 5% expanded perlite, the mold is approaching the "too hard", "too impermeable" stage, while at 25% expanded perlite, the resulting mold is approaching the "too soft" stage.

EXAMPLE III

This example illustrates other variations of the percentage components withing the preferred ranges. Thus, Run W had 50% gypsum plaster, 19% fibrous wollastonite, 12% expanded perlite, and 19% sand; Run X was 55% plaster, 17% fibrous wollastonite, 11% expanded perlite, and 7% sand; Run Y was 65% plaster, 13% fibrous wollastonite; 9% expanded perlite, and 13% sand; and Run Z had 70% plaster, 11% fibrous wollastonite, 8% expanded perlite, and 11% sand. All of the preparation conditions were the same, and the components were of the same grade and from the same sources as in Examples I and II. An accelerator (Terra Alba) was also used. The results are given in Table V.

TABLE V

| | Bulk Density pcf | | MOR psi | | Burnout Shrinkage | Permeability AFS | Penetration Resistance |
|---|---|---|---|---|---|---|---|
| | Wet | Dry | Wet | Dry | % | No. | lbs. |
| W | 90 | 42 | 58 | 57 | 0.04 | 0.67 | 14 |
| X | 91 | 44 | 80 | 68 | 0.03 | 0.70 | 16 |
| Y | 90 | 44 | 104 | 84 | 0.04 | 0.79 | 20 |
| Z | 90 | 44 | 109 | 79 | 0.05 | 0.86 | 19 |

All data indicate satisfactory performance. The molds were acceptable from the standpoint of slurry characteristics, and wet and dry mold features.

In this example, as in Examples I and II, the filler used was sand. However, other filler materials may be used as a partial or complete replacement for sand. Sand is merely preferred because it is inexpensive and because its chill properties are particularly desirable. Fly ash is also relatively inexpensive and, in addition, aids in improving the permeability of the mold. The general guide for amounts of fly ash which may be substituted for sand is between 0 and 20 weight percent.

Between 0 and 20 weight percent of pyrophyllite may also be used as a partial or complete replacement for the sand. Pyrophyllite is a particularly desirable component of the molding composition since it improves the mold surface characteristics to produce better cast metal surfaces. Pyrophyllite is $Al_2O_3.4\ SiO_2.H_2O$ and is available under the trade name Pyrax from R. T. Vanderbilt Co. of Norwalk, Connecticut.

Finally, it should be noted that in this and the other examples, a Terra Alba accelerator was used in small amounts (approximately 1-2% by weight of plaster — more or less can be used depending on the circumstances). Terra Alba is a hydrous calcium silicate. It is a known accelerator for gypsum plaster, see U.S. Pat. No. 2,940,403. Other known accelerators may be used in place of Terra Alba.

As can be seen from these examples the present invention provides a suitable fibrous talc-free metal castings molding composition having dry blend, slurry, wet and dry mold properties equal to or better than prior fibrous talc containing compositions. Accordingly, the need in the industry for a replacement for molding compositions containing fibrous talc has been met with this invention.

While the composition herein described constitutes a preferred embodiment of the invention, it is to be understood that the invention is not limited to this precise composition, and that changes may be made therein without departing from the scope of the invention.

What is claimed is:

1. A fibrous talc-free metal castings molding composition having good dry blending properties, slurry characteristics, and wet and dry mold features, consisting by weight essentially of: approximately 50-70% gypsum plaster, 5-20% fibrous wollastonite, 5-25% fine expanded perlite, at least 50% of which will pass through a −50 mesh screen, and 0-40% filler.

2. A molding composition as set forth in claim 1 wherein said filler is selected from the group consisting of sand, fly ash, pyrophyllite, and mixtures thereof.

3. A molding composition as set forth in claim 2 wherein said expanded perlite is present in the amount of approximately 7.5 - 15% by weight.

4. A molding composition as set forth in claim 3 further including a Terra Alba accelerator at approximately 1-2% by weight of said plaster.

5. A molding composition as set forth in claim 1 wherein said wollastonite is a fibrous, acicular material having a 50% median size of 22 microns, said expanded perlite is a very fine material with 85% passing a −325 mesh screen, and said sand is approximately −70 mesh sand.

6. A molding composition as set forth in claim 5 wherein said expanded perlite is present in the amount of approximately 7.5 - 15% by weight.

7. A molding composition as set forth in claim 5 consisting by weight of approximately 60% gypsum plaster, 15% fibrous wollastonite, 10% fine expanded perlite, 15% sand, and a Terra Alba accelerator at approximately 1-2% by weight of said plaster.

8. A molding composition as set forth in claim 5 consisting by weight of approximately 60% gypsum plaster, 15% fibrous wollastonite, 15% fine expanded perlite, 10% sand, and a Terra Alba accelerator at approximately 1-2% by weight of said plaster.

9. A molding composition as set forth in claim 1 wherein said filler contains pyrophyllite present in the amount of approximately 0-20% by weight to improve the cast metal surface characteristics.

* * * * *